United States Patent [19]

Ashworth

[11] Patent Number: 5,058,173

[45] Date of Patent: Oct. 15, 1991

[54] COMBINATION INERTIA TYPE AUDIO TRANSDUCER AND LOUDSPEAKER

[76] Inventor: William J. Ashworth, 1012 Ashworth Cove, Altamonte Springs, Fla. 32714

[21] Appl. No.: 461,302

[22] Filed: Jan. 5, 1990

[51] Int. Cl.[5] ..... H04R 3/02; H04R 25/00

[52] U.S. Cl. ..... 381/152; 381/73.1

[58] Field of Search ..... 381/152, 73.1; 181/157, 181/158, 160, 161, 163

[56] References Cited

U.S. PATENT DOCUMENTS

| | | | |
|---|---|---|---|
| 3,178,512 | 4/1965 | Ashworth | 381/152 |
| 3,449,531 | 6/1969 | Ashworth | 381/152 |
| 3,509,282 | 4/1970 | Ashworth | 381/152 |
| 3,728,497 | 4/1973 | Kamatsu | 381/152 |
| 4,064,376 | 12/1977 | Yamada | 381/152 |
| 4,914,750 | 4/1990 | Lawson | 381/152 |

*Primary Examiner*—James L. Dwyer
*Assistant Examiner*—Jason Chan

[57] ABSTRACT

An audio transducer for activating a sounding board and a loudspeaker combined in one structure operating together simultaneously and using only one activating diaphragm to drive a sounding board and to produce sound pressure in an air cavity inside the transducer structure and expelling the sound pressure developed in the air cavity.

5 Claims, 1 Drawing Sheet

COMBINATION INERTIA TYPE AUDIO TRANSDUCER AND LOUDSPEAKER

BACKGROUND OF THE INVENTION

The present invention relates to audio transducers and loudspeakers, and more particular, the combining of a diaphragm type loudspeaker and an inertia type audio transducer into one structure with a single activating diaphragm which drives a sounding board and is wholly supported by the sounding board and at the same time is a separate loudspeaker created by an air cavity formed inside the transducer structure. Heretofore, audio transducers have been proposed, for example, my prior U.S. Pat. Nos. 3,178,512, 3,334,195, 3,449,531, and 4,151,379. The present invention provides a novel method of combining a loudspeaker and an audio transducer into one structure with a single activating diaphragm. Applicant is not aware of any prior art that is in any way similar to the present invention.

SUMMARY OF THE INVENTION

Audio transducers and diaphragm loudspeakers are well known to the art and their operation will not be explained in this application. The present invention provides a method of combining a loudspeaker and an audio transducer into a single structure with a single activating diaphragm which considerably improves the performance of the audio transducer when it only drives a sounding board. The present invention utilizes an audio transducer comprising a magnetically activated vibratile diaphragm which is attached to a sounding board. The vibratile diaphragm is attached to structure comprising a tubular shaped permanent magnet biasing means with a resiliant pad. A magnetic core with a coil of wire for electrically energising the magnetic core is wound around the magnetic core. A magnetic core is supported by a magnetizable support plate attached to the end of the magnetic biasing means opposite the vibratile diaphragm. The support plate has an opening or openings in it to release sound wave energy from the air cavity formed inside the structure of the present invention when the magnetically activated vibratile diaphragm is set in motion. When the vibratile diaphragm is set in motion by an electrical signal, the sounding board that the structure is attached to will vibrate and produce sound. At the same time the sounding board is producing sound, the same vibratile diaphragm developes acoustic energy in the air cavity inside the transducer structure, which is released thru the openings in the magnetizable core support plate into the listening area. The opening or openings should be at least five percent of the area of the opening in the air cavity that comes in contact with the core mounting plate . The sound produced by the sounding board and the sound from the transducer sound chamber is substantially in phase with each other. The present invention considerably expands the volume of sound that would be obtainable from the audio transducer's sounding board alone without the additional sound generated by the sound chamber into the listening area. In some cases, depending on the type of sounding board, the frequency range of the sound will be expanded. The present invention may be used together with an additional convention dynamic loudspeaker or loudspeaker to produce a sound delay effect giving an illusion of, or real reverberation.

DESCRIPTION OF THE PREFERRED EMBODIMENTS

Figure 1:
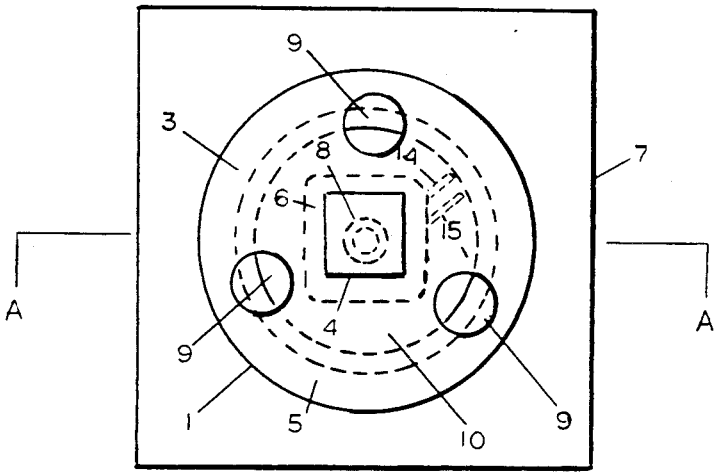
FIG. 1 is a top view of the present invention.
Figure 2:
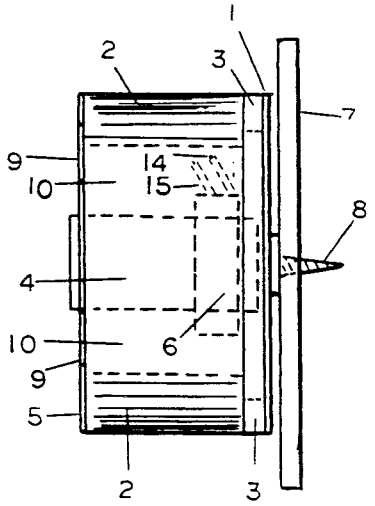
FIG. 2 is a side view of the present invention.
Figure 3:
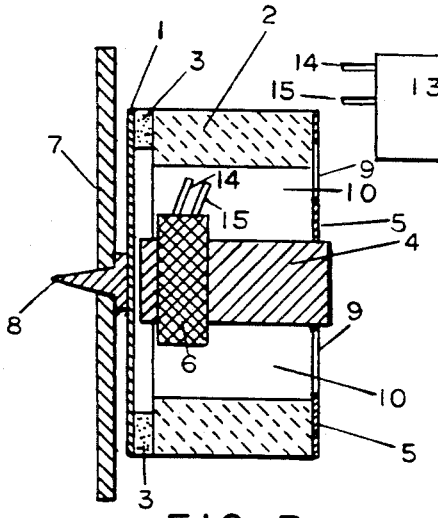
FIG. 3 is a sectional view taken along A—A of FIG. 1.
Figure 4:
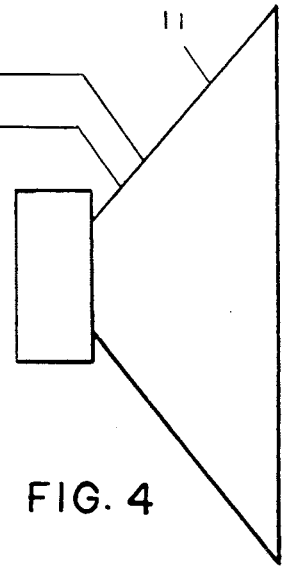
FIG. 4 is a schematic view of a conventional loudspeaker being used together with the present invention.

A magnetically activated vibratile plate is attached to a circular permanent magnet 2 with circular pad 3 that may be constructed from foam rubber such as neoprene that is interposed between the magnet and the vibratile plate. A suitable cement such as contact cement is used to fasten pad 3 in place. Plate 1 may be constructed from 24 gauge cold rolled steel. Core 4 is attached to mounting plate 5 with a suitable cement such as epoxy. Core 4 may be constructed from laminated electrical steel or other suitable core material well known to the art. Mounting plate 5 may be constructed from 24 gauge cold rolled steel. Plate 5 is rigidly attached to magnet 2 with a suitable cement such as epoxy. Core 4 has a coil 6 of wire wound on it and coil 6 is energized by an external electrical signal thru leads 14–15. The entire transducer structure is attached to sounding board 7 with screw 8 or any other suitable means such as double faced adhesive tape. Mounting plate 5 has an opening or openings 9 in it to provide an outlet for sound produced in sound chamber 10. To develop enough sound pressure to properly function as a loudspeaker in conjunction with sounding board 7, air cavity 10 should have a volume size of at least 0.5 cubit inch of open air space and vibratile plate 1 should have at least one square inch of surface contact with the open air space of the air cavity 10. A transducer housing, although not shown, may be used for cosmetic purposes. This housing , if used, must have an opening or openings provided to provide a sound outlet for the air cavity. Screw 8 may be offset rather than centered as shown in the drawings. The frequency response may be adjusted by offsetting screw 8. FIG. 4 is a schematic view of a conventional loudspeaker 11 being used together with the present invention. A conventional dynamic speaker or speakers 11 may be connected in parallel with the present invention with sound volume balancing means 12 such as a fixed or varible resistor placed in the loudspeaker 11 circuit to balance the sound volume between speaker 11 and the present invention. Both speaker 11 and the present invention will usually be powered by the same electrical signal 13 but they may be driven by different signals. Although one form of the present invention has been shown, it will be understood that details of the construction shown may be altered or omitted without departing from the spirit of this disclosure as defined by the following claims.

I claim:

1. A single structure comprising an audio transducer attached to and wholly supported by a sounding board with said sounding board being activated by a vibratile diaphragm attached to and facing said sounding board, said audio transducer comprising an integral loudspeaker that is embodied in said transducer and is activated by said vibratile diaphragm, said loudspeaker of said transducer being created by an air cavity at least 0.5 cubic inches in volume inside said transducer, with said air cavity being adjacent to the side of said vibratile diaphragm opposite the side of said vibratile diaphragm facing said sounding board where said air cavity that is adjacent to said vibratile diaphragm having a contact area of at least one square inch with said diaphragm and extends away from said vibratile diaphragm and terminates at an air venting means attached to a venting end of said transducer that is opposite to an end of said transducer to which said vibratile diaphragm is attached, whereby said air venting means has an open space therein with an area of at least five percent of the size of the area of contact of said air cavity with said venting end of said transducer.

2. The structure according to claim 1 used in combination together with a conventional dynamic loudspeaker means with said sound producing device and said dynamic loudspeaker being activated by a common signal source.

3. The combination according to claim 2 whereby sound volume balancing means is interposed between said sound producing device and said dynamic loudspeaker.

4. The structure according to claim 1 whereby said vibratile diaphragm is fastened to a sounding board with a screw attached to said vibratile diaphragm.

5. The structure according to claim 4 where said screw is attached to said vibratile plate in an off center position.

* * * * *